US005740585A

United States Patent [19]

Shapiro

[11] Patent Number: 5,740,585

[45] Date of Patent: Apr. 21, 1998

[54] CHILD SAFETY DEVICE

[76] Inventor: Harold L. Shapiro, 5812 Jane Way, Alexandria, Va. 22310

[21] Appl. No.: 181,075

[22] Filed: Jan. 14, 1994

[51] Int. Cl.[6] ..... E05C 17/60

[52] U.S. Cl. ..... 16/82; 16/86 R; 16/86 B; 16/83

[58] Field of Search ..... 16/82, 85, 86 R, 16/86 A–86 C, 83; 49/70, 322

[56] References Cited

U.S. PATENT DOCUMENTS

| | | | |
|---|---|---|---|
| 1,664,174 | 2/1928 | Hoopes, Jr. | 16/86 R |
| 3,786,533 | 1/1974 | O'Donnell | 16/82 |
| 4,028,772 | 6/1977 | Salerno | 16/86 A |
| 4,165,553 | 8/1979 | Salerno | 16/86 A |
| 5,369,840 | 12/1994 | Salvador et al. | 16/82 |

FOREIGN PATENT DOCUMENTS

| | | | |
|---|---|---|---|
| 152184 | 4/1932 | Switzerland | 16/86 A |

*Primary Examiner*—Steven C. Bishop
*Attorney, Agent, or Firm*—Barnes & Thornburg

[57] ABSTRACT

A child safety device which prevents children from closing sliding doors and windows which includes a blocking member which is attached to a door or window frame by an attachment member which allows the blocking member to be positioned in a blocking position wherein the blocking member blocks the door or window from being closed.

16 Claims, 2 Drawing Sheets

CHILD SAFETY DEVICE

TECHNICAL FIELD

The present invention relates to child safety devices which will prevent children from harming themselves with sliding closures, including sliding doors, windows, and the like. More particularly, the present invention relates to a child safety device which will prevent sliding closures, such as sliding glass patio doors, windows and the like from being completely closed by young children.

BACKGROUND ART

A concern for child safety has, in one aspect, focused on numerous every day devices which, although utilized without much thought by adults, pose potential hazardous situations for children, especially young infants and toddlers. For example, most people realize the dangers associate with stairs. Children, especially young infants whose sense of balance is not developed, do not appreciate the dangers associated with stairs. Therefore, it is conventional practice to install child safety gates at the top and/or bottom of staircases.

Other child safety concerns have lead to the development of special door and drawer latches or locks which prevent children from opening kitchen cabinet doors, drawers, and the like. Likewise, a number of safety covers for electrical outlets and covers for electrical outlets into which electrical appliances are plugged have been developed to prevent electrical shocks to young children.

Other child safety device include elaborate and expensive monitoring devices, including audio monitors and video monitoring systems.

Although various locking devices have been developed, one neglected area of child safety recognized by the present invention is the dangers associated with sliding closures, particularly sliding doors.

U.S. Pat. No. 4,165,553 to Salerno discloses a sliding door safety device which includes a resilient ball that is attach to a pivoting rod.

U.S. Pat. No. 4,028,772 to Salerno discloses a resilient ball which is attached to a string which is mounted in the path of a sliding door. This device has the disadvantage that the sliding closure closes on the string thereby subjecting the string to damage over time.

The present invention provides a safety device for sliding closures which is simple and more effective in preventing serious injury to children, especially young infants.

DISCLOSURE OF THE INVENTION

It is accordingly one object of the present invention to provide for a child safety device.

It is another object of the present invention to provide for a child safety device which will prevent children, especially young infants and toddlers from being injured by sliding closures, including sliding doors, windows and the like.

It is a further object of the present invention to provide for a child safety device which will prevent unsupervised children, especially young infants and toddlers from completely closing sliding closures, including sliding doors, windows and the like.

It is still a further object of the present invention to provide for device which is automatically positioned to prevent the accidental closing of sliding closures, including sliding doors, windows and the like by children, toddlers and young infants.

A still further object of the present invention is to provide a method for automatically preventing children, toddlers and young infants form closing sliding closures, including sliding doors, windows and the like.

According to the present invention there is provided a child safety device which includes:

a blocking member having two parallel opposed sides; and an attachment member comprising a strap having a width and opposed ends, the attachment member being attached to the blocking member at one of the opposed ends, the other of the opposed ends of the attachment member including means for attaching the blocking member to a frame supporting a sliding closure member so that the blocking member is automatically positioned in an operable position in which at least a partial sliding movement of the sliding element is prevented by the blocking member.

Also provided by the present invention is a method of preventing a sliding closure form being completely closed which includes:

providing a safety device which includes a blocking member having two parallel opposed sides, and an attachment member comprising a strap having a width and opposed ends, the attachment member being attached to the blocking member at one of the opposed ends;

attaching the other of the opposed ends of the blocking member to a frame supporting a sliding closure member; and allowing the blocking member to become automatically positioned in an operable position when the sliding closure is opened, the blocking member preventing the sliding closure from being completely closed when positioned in the operable position.

BRIEF DESCRIPTION OF DRAWINGS

The present invention will now be described with reference to the annexed drawings which are given for illustration purposes only, but which are not to be considered as limiting the broader aspects and/or embodiments of the present invention in which.

Figure 1:
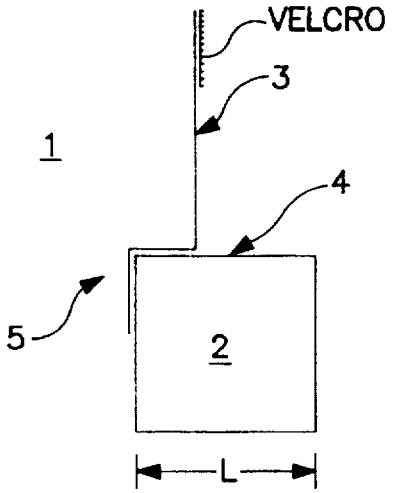
FIG. 1 is a side view illustration of a safety device according to one embodiment of the present invention.

FIGS. *6a–6e* illustrate other shapes of safety devices according to further embodiments of the present invention.

FIGS. *7a–7b* illustrate other shapes of safety devices according to further embodiments of the present invention.

BEST MODE FOR CARRYING OUT THE INVENTION

The present invention relates to a child safety device which is designed to prevent young children, particularly toddlers, from completely closing sliding closures such as glass patio doors, sliding windows, or the like.

According to the present invention, an appropriately shaped blocking member having parallel opposed sides is attached within or adjacent to a frame of a sliding door, window, or the like by a attachment member which allows the blocking member to attain a blocking position, at which, under the influence of gravitational or other biasing forces, the blocking member is positioned within the frame and properly aligned with respect to the adjacent frame edge and leading edge of the sliding closure so as to prevent the sliding closure, e.g. door, window, or the like, from being completely closed.

The attachment member is suitably flexible or deflectable so as to allow the blocking member to be positioned away from or out of the frame so that the sliding door, window, or the like, may be completely closed without contacting or being obstructed by the blocking member.

According to the present invention, the blocking member which is supported by the attachment member, automatically drops or swings into an operable or blocking position when the sliding door, window, or the like, is opened beyond a predetermined position, which at least corresponds to the width of the blocking member. When closing the sliding door, window, or the like, the blocking member can be manually moved from the operable or blocking position to an inoperable position, while remaining supported by the attachment member.

Accordingly, when the sliding door, window, or the like, is opened, the blocking member automatically moves to the operable or blocking position and therein prevents to the operable or blocking position and therein prevents the door, window, or the like, from being completely closed until the blocking member is removed from the operable or blocking position. By appropriately attaching the device to an upper portion of the frame, small, young children, particularly toddlers, are unable to reach the blocking member or remove it from the operable or blocking position. Thus, the device automatically prevents young children from closing heavy, sliding closures such as glass doors, windows, and the like, and injuring themselves or others.

The device of the present invention includes a blocking member and an attachment member for attaching the blocking member to or into the frame of a door, window, or the like. The blocking member, as discussed in detail below, is shaped and supported by the attachment member in a particular manner which allows the blocking member to automatically drop or swing into the operable or blocking position when the sliding door, window, or the like, is opened beyond a predetermined position. The blocking member may be made of any solid material which will withstand the force of the sliding closure and block the sliding door, window, or the like from being fully closed. In this regard, the blocking member may be made from metal or wood, but more preferably, is made from a material or coated with a material which will not adversely mar, mark, chip, scratch, or otherwise damage the frame, or door, or window, or the like. Suitable materials which will not cause damage to the door, window, frame, etc. include various plastics, rubbers, resinous materials, and the like. It is deemed that the particular choice or selection of these materials would be obvious to one skilled in the art.

According to the present invention, the attachment member supports the blocking member in a particular alignment within the frame of the sliding closure so that parallel opposed surfaces of the blocking member are substantially perpendicular to the direction in which the sliding closure moves between its open and closed position.

In order to properly align the blocking member, the attachment member, which is in the form of a strap, web, or belt, has a width which prevents twisting of the suspended blocking member as discussed in more detail below.

The attachment member may be made from any suitable material which is able to support the blocking member. Suitable materials for the attachment member include cloth, fiber, plastics, rubbers, leather, wire, and the like. In this regard, the function of the attachment member is to attach the safety device to or into the frame of the door, window, or the like, in a manner so that the blocking member is free to swing or drop with respect to the frame. Therefore, any suitable material may be utilized for the attachment member.

The attachment member may be either attached to the blocking member or formed integral therewith, as in the case wherein the blocking member and the attachment are formed from an integral plastic material. In instances wherein the attachment member is to be attached to the blocking member, suitable attachment may be achieved by utilizing any conventional fastening means, including screws, rivets, nails, or equivalent means, or adhesives, epoxies, or the like.

The safety device, as discussed above, is designed to be attached to or into the frame of a door, window, or the like, as will be more fully discussed below. In this regard one end of the attachment member which is distant from the blocking member may include through-holes through which screws, nails, or similar fastener means may by driven so as to fasten the attachment member to the frame. Otherwise, the same end of the attachment member may include an area of adhesive by which the attachment member may be adhered to the frame. Similarly, the frame and attachment member may include Velcro® portions by which the attachment member could be attached to the frame.

FIG. 1 is a side view illustration of the safety device according to one embodiment of the present invention. In FIG. 1 the safety device is generally illustrated by reference number 1 and includes blocking member 2 and attachment member 3. Similar reference numbers are utilized throughout the drawings to represent the same elements.

In the embodiment illustrated in FIG. 1 the block member 2 comprises a substantially square structure as viewed from the side thereof. The blocking member in a preferred embodiment is made from hard rubber or solid plastic. The attachment member 3 is attached to the block member in a manner so that when the blocking member is supported by the attachment member as illustrated in FIG. 1, the upper surface 4 of the blocking member is substantially horizontal.

In regards to the dimensions of the safety device as illustrated in FIG. 1, it is important that the attachment member be long enough to ensure that the blocking member, when supported by the attachment member extends in the path of the sliding door or window member, as discussed more fully below. Practical lengths may be from about 2 to 6 inches or longer. The blocking member has a length "L" as shown in FIG. 1 which is long enough to insure that, when suspended by the attachment member, the blocking member lies in the path of the sliding closure member. Preferred lengths are 2 to 6 inches or greater. The thickness of the blocking member "D", as illustrated, needs to be on the order of the width of a child's hand, foot, or any extreme body part which a child might catch in the sliding door or window, for example a child's head. For practical purposes, the thickness "D" should be at least 1.5 inches to protect a child's fingers, 4 inches to protect a child's hands or feet, and 8 inches or more to protect a child's head. These dimensions can be adjusted as desired. The parallel opposed surfaces of the blocking member which contact between the closure frame and the leading edge of the sliding closure should have a vertical dimension of at least 2 inches where the blocking member is contacted by the closure frame and the leading edge of the sliding closure in order to ensure that the blocking member will not be deflected upon contact if it is slightly out desired alignment in the path of the closure.

Figure 2:
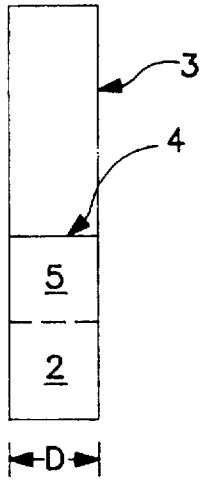
FIG. 2 is an end view illustration of the safety device of FIG. 1.
Figure 3:
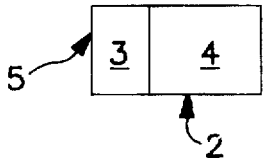
FIG. 3 is a top view illustration of the safety device of FIG. 1.

The embodiment of the safety device illustrated in FIGS. 1–3 has a substantially rectangular cross section as viewed from the end and top thereof. The attachment member 3 is attached at least partially along one end 5 of the blocking member and along a portion of the upper surface 4 as illustrated in FIGS. 1–3. This manner of attachment insures adequate support of the blocking member and orientation so that the upper surface is substantially horizontal when the blocking member is supported by the attachment member.

In the embodiment of the invention shown in FIG. 2, the attachment member 3 has a width which is equal to the width "D" of the blocking member. As discussed above, it is important that the attachment member supports the blocking member in a particular alignment within the frame of the sliding closure so that parallel opposed surfaces (parallel to the plane of the paper in FIG. 1) of the blocking member are substantially perpendicular to the direction in which the sliding closure moves between its open and closed position. In order to ensure this alignment, the attachment member has a rectangular cross-section and is provided with a width which is sufficient to prevent twisting of the suspended blocking member. The width of the attachment member can be equal to the width "D" of the blocking member or less. For purposes of the present invention the width of the attachment member should be at least 1 inch. It has been determined that the proper alignment of the blocking member can be achieved by provided two or more spaced apart strings, cords, wires or the like in place of the illustrated attachment member.

In a further embodiment, the attachment member has a width as noted above and is made from a semi-rigid material which will resist twisting as the blocking member is moved from the inoperable position to the operable or blocking position. Suitable materials for the attachment member in this embodiment include plastics, leather, and the like.

Figure 4:
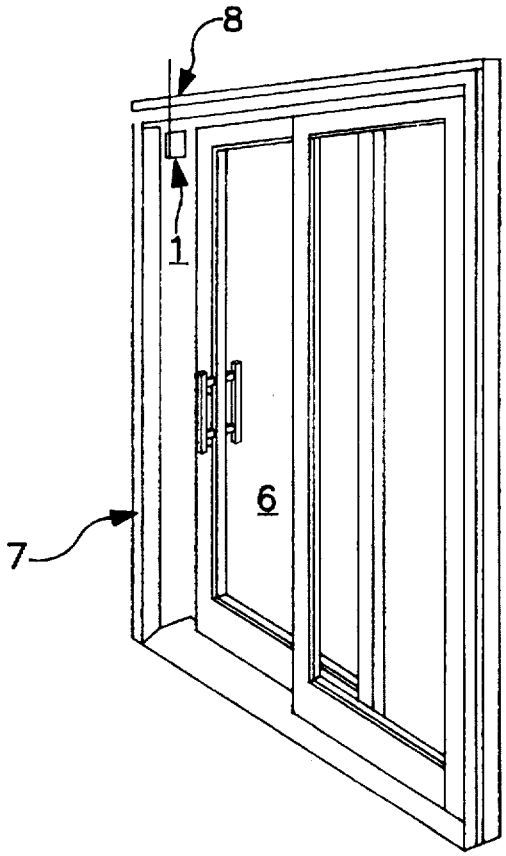
FIG. 4 is an illustration of a safety device according to the present invention in use in an open door passageway.

FIG. 4 is an illustration of the safety device according to the present invention in use in an open door passageway. In FIG. 4 the sliding panel of the door 6 is illustrated in an open position of door frame 7. The attachment member is attached to an interior upper portion 8 of the door frame adjacent one side of the door frame to which the door closes. The end of the attachment member which is most distant from the blocking member is attached to the interior upper portion of the door frame by suitable attachment means as discussed above. In FIG. 4 the blocking member is in the operable or blocking position.

Figure 5:
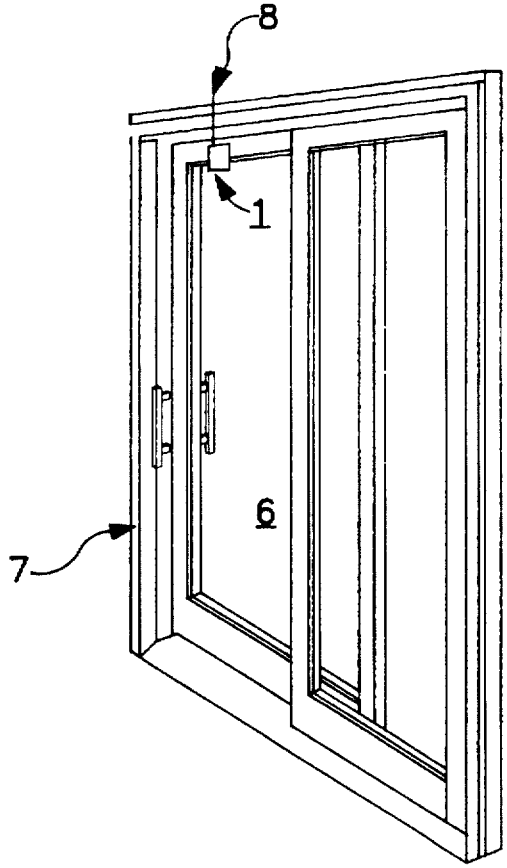
FIG. 5 is an illustration of a safety device according to the present invention in use in a closed door passageway.

FIG. 5 is an illustration of the safety device according to the present invention in use in a closed door passageway. In FIG. 5, door 6 is illustrated in the closed position. In order to close the door it is necessary that the blocking member be manually moved from the operable or blocking position illustrated in FIG. 4 wherein the blocking member is in the path of the door to the inoperable position shown in FIG. 5. In the inoperable position illustrated in FIG. 5 the blocking member is in a position in which it hangs down from the attachment member attached to the door frame and rests on an interior surface of the door. In this position the blocking member is allowed to "fall" into the blocking position illustrated in FIG. 5 when the door is moved toward the open position and passes the position whereat it supports the blocking member in the position illustrated in FIG. 5.

In order to closed the door, it is necessary to remove the blocking member form the position illustrated in FIG. 4. This is done by manually moving the blocking member out of the path of the sliding door. Thereafter, when the door is closed, the blocking member is allowed to rest on the door as illustrated in FIG. 5 so that it may again fall into the blocking when the door is open.

The blocking member is attached to the interior upper portion of the door frame so that young children are not able to reach and remove the blocking member from the blocking position. The blocking member is attached to the upper portion of the door frame to the side closely adjacent the side of the frame to which the door closes so as to block the closing of the door. In an alternative embodiment of the present invention the attachment member can be made of a rigid or semi-rigid flexible material such a plastic or spring metal. In this embodiment, the biasing force of the attachment member can either supplement or substitute for the force of gravity which acts upon the blocking member. In this embodiment, the safety device can be attached to the side of the sliding closure frame and the blocking member can be positioned into the path of the sliding closure by the biasing force of the attachment member.

Figure 6A:
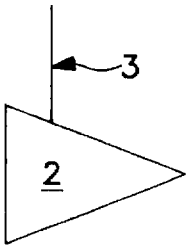
Figure 6B:
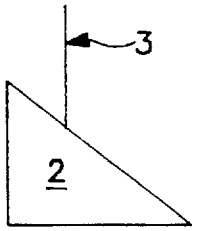
Figure 6C:
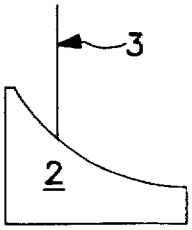
Figure 6D:
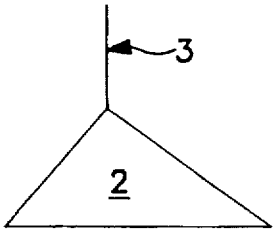
Figure 6E:
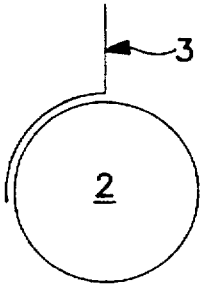

FIGS. **6*a*–6*e* illustrate other shapes of the safety device according to further embodiments of the present invention. In FIG. 6*a* the side of the blocking member 2 is illustrated as having an isosceles triangular shape and being suspended so that base of the triangle is substantially vertical when suspended by attachment member 3** in the operable or blocking position.

FIG. **6*b* illustrates the side of blocking member 2 as being in the shape of a right angle triangle and being suspended from the attachment member so that the major leg of the triangle is substantially horizontal when suspended by attachment member 3** in the operable or blocking position.

FIG. **6*c* illustrates the side of blocking member 2 as being in the shape of a right angle triangle with the hypotenuse having a concave shape. The blocking member is illustrated as being suspended from the attachment member so that the major leg of the triangle is substantially horizontal when suspended by attachment member 3** in the operable or blocking position.

FIG. **6*d* illustrates the side of blocking member 2 as being in the shape of an oblique triangle with the attachment member supporting the blocking member so that the height with respect to the largest leg is substantially vertical when suspended by attachment member 3** in the operable or blocking position.

FIG. **6*e* illustrates the side of blocking member 2** as being of a circular shape.

Figure 7A:
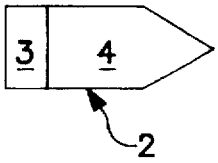
Figure 7B:
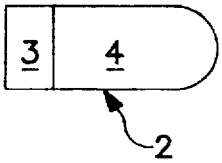

FIGS. **7*a*–7*b* illustrate other shapes of the safety device according to further embodiments of the present invention as viewed from the top of the blocking member. FIG. 7*a* illustrates the blocking member as having two parallel opposed sides which terminate into angular portions that converge at a point. FIG. 7*b* illustrates the blocking member as having two parallel opposed sides which terminate into curved portions which converge together. In FIGS. 7*a*–7*b* the attachment member would attach to the blocking member along the top and left handed end as illustrated. Various combinations of the shapes illustrated in FIGS. 1–3, 6*a*–6*d* and 7*a*–7*a*** may be utilized in the present invention.

Although the invention has been described with reference to particular means, materials and embodiments, from the foregoing description, one skilled in the art can easily ascertain the essential characteristics of the present invention and various changes and modifications may be made to adapt the various uses and conditions without departing from the spirit and scope of the present invention as described by the claims which follow.

I claim:

1. In a sliding closure assembly including a frame and a sliding closure member which is slidable in said frame between an open position and a closed position, the improvement comprising a child safety device which includes:

a blocking member having two parallel opposed sides; and an attachment member comprising a strap having a width and opposed ends, said attachment member being attached to said blocking member at one of said opposed ends, the other of said opposed ends of said attachment member being attached to said frame, whereby as said sliding member is moved from said closed position to an open position, said blocking member is urged into an operable position between said sliding member and said frame so as to prevent said sliding member from being slid into said closed position.

2. A sliding closure assembly according to claim 1, wherein said blocking member and said attachment member comprise an integral structure.

3. A sliding closure assembly according to claim 1, wherein said attachment member is made from a non-rigid material so that said blocking member is urged in the operable position by gravitational force.

4. A sliding closure assembly according to claim 1, wherein said attachment member is made from a flexible material which provides a biasing force for urging said blocking member in said operable position.

5. A sliding closure assembly according to claim 1, wherein said width of said attachment member is 1 inch or greater.

6. A sliding closure assembly according to claim 1, wherein said attachment member includes a Velcro® portion by which it is attached to said frame.

7. A sliding closure assembly according to claim 1, wherein said blocking member has a square cross sectional shape.

8. A sliding closure assembly according to claim 1, wherein said blocking member has a triangular cross sectional shape.

9. A sliding closure assembly according to claim 1, wherein said blocking member is made from a material selected from the group consisting of wood, metal, plastics, resins, rubbers and combinations thereof.

10. A sliding closure assembly according to claim 1, wherein said attachment member is made from a material selected from the group consisting of cloth, fiber, plastics, rubbers, leather, wire and combinations thereof.

11. A sliding closure assembly according to claim 2, wherein said blocking member and said attachment member are made from plastics or rubbers.

12. A sliding closure assembly according to claim 1, wherein said sliding member comprises a door.

13. A sliding closure assembly according to claim 1, wherein said sliding member comprises a window.

14. A method of preventing a sliding closure form being completely closed which comprises:

providing a safety device which includes a blocking member having two parallel opposed sides, and an attachment member comprising a strap having a width and opposed ends, said attachment member being attached to said blocking member at one of said opposed ends;

attaching the other of said opposed ends of said blocking member to a frame supporting a sliding closure member; and allowing said blocking member to become automatically positioned in an operable position when said sliding closure is opened, said blocking member preventing said sliding closure from being completely closed when positioned in said operable position.

15. A method of preventing sliding closures form being closed according to claim 14, wherein said attachment member allows said blocking member to rest on said closure when said closure is in a closed position.

16. A method of preventing sliding closures form being closed according to claim 14, wherein said closure is selected from the group consisting of sliding doors and windows.

* * * * *